United States Patent [19]

Murakami et al.

[11] 4,253,323

[45] Mar. 3, 1981

[54] METHOD FOR MANUFACTURING HIGH PRECISION SLUGS

[75] Inventors: Kinshiro Murakami; Atsumu Hakoyama; Masakazu Yamazaki, all of Sagamihara; Hisanobu Kanamaru, Katsuta; Yasushi Ouchi, Ibaragi; Akira Tohkairin, Katsuta, all of Japan

[73] Assignees: Aida Engineering, Ltd., Kanagawa; Hitachi, Ltd., Tokyo, both of Japan

[21] Appl. No.: 24,036

[22] Filed: Mar. 26, 1979

[30] Foreign Application Priority Data

Mar. 24, 1978 [JP] Japan ..... 53-33136

[51] Int. Cl.[3] ..... B21D 22/02

[52] U.S. Cl. ..... 72/356; 29/159.2; 72/377

[58] Field of Search ..... 72/356, 377, 343, 352; 29/159.2

[56] References Cited

U.S. PATENT DOCUMENTS

| | | | |
|---|---|---|---|
| 1,303,577 | 5/1919 | Murray | 72/356 |
| 3,169,638 | 2/1965 | Reinberger | 72/356 |
| 4,069,571 | 1/1978 | Nelson | 72/377 |
| 4,111,031 | 9/1978 | Vennemeyer | 72/377 |

*Primary Examiner*—Leon Gilden
*Assistant Examiner*—Gene P. Crosby
*Attorney, Agent, or Firm*—Wenderoth, Lind & Ponack

[57] ABSTRACT

A method is provided for the formation of high precision metal slugs by cold forming. A metal column starting material is subjected to a preforming step in which the starting material is cold forged with a pair of upper and lower metal dies provided with concave recesses to produce a primary product having a barrel shape having a high degree of parallelism on the ends. The resultant primary product is subjected to an upsetting step in which the barrel shape is crushed while maintaining parallelism to obtain a secondary product. The resultant secondary product is then subjected to an ironing step in which the outer diameter of the secondary product is reduced to obtain a high precision slug having an outer diameter which is substantially the same as the outer diameter of the desired final product for which the slug will be utilized.

5 Claims, 10 Drawing Figures

METHOD FOR MANUFACTURING HIGH PRECISION SLUGS

DESCRIPTION OF THE INVENTION

The present invention provides a method for manufacturing high precision metal slugs by cold forming. By high precision slugs is meant slugs having low dimentional disparity in parallelism at the two ends, A, B, in the axial direction and the maximum outer diameter, D, as shown in FIG. 1.

In the prior art, efforts have been made to extend the durability of metal dies used in cold forming processes by improving precision of metal dies used in the final stage of the manufacture of high precision products by cold forming. However, merely improving precision of the metal dies does not necessarily improve the precision of the cold formed products nor extend the durability of the metal dies if the slugs themselves have inferior precision.

FIGS. 10*a* and 10*b* show the conventional manufacturing method of slugs in the art wherein column slugs 2 are manufactured from the column material 1 in one step. According to this method, when the column 1 material is fed to the center 0—0 at the central hollow section of the metal die 3 eccentrically by $\delta$ and pressure is applied by the top and bottom punches 4 and 5, one end of the column slug 2 becomes deformed as shown in the drawing indicated by C. This impairs parallelism at both ends A, B in the axial direction. In other words, the resulting slugs have different heights, H and H'.

The starting column material 1 is usually obtained by cutting bars, and it is unavoidable that the surface of the cut sections will have an angle of inclination $\alpha$. As a result, a part of the pressurizing force working on the ends acts to move the column material to the side, and the column material 1 becomes misaligned in respect to the metal die even if it is placed in the center. Thus the finished slugs become either deformed or have impaired parallelism at their ends.

The object of the present invention is to provide a method of manufacturing slugs with high precision even when the cut faces of the column materials are rough or even when the parallelism is impaired.

Another object of the present invention is to provide a method of manufacturing high precision slugs which are easily deformable in the processing of the final product as their fibers in the axial direction are crushed by the column material being subjected to several stages of processing before they are made into finished slugs.

Still another object of the present invention is to provide a method of manufacturing high precision slugs for use in obtaining high precision products and preventing misalignment in the final product.

Yet another object of the present invention is to provide a method of manufacturing high precision slugs which may remarkably improve the durability of the metal dies used in manufacturing the final finished products.

The present invention in sum provides a method of manufacturing high precision slugs having excellent parallelism at both ends and smaller deviations in the outer diameter, said method comprising (1) a step of preforming wherein parallelism is improved at both ends of the resulting primary product which has a barrel shape with its outer diameter in the center of the column being somewhat greater than the outer diameter at the ends; (2) a step of upsetting to provide a secondary product having the outer diameter which is required for the following step, said upsetting step being conducted by crushing the barrel shape while maintaining the parallelism; and (3) a step of ironing in which the outer diameter of the slug is reduced to substantially the same as the necessary outer diameter of the desired product.

Figure 1:
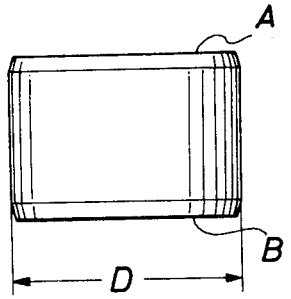
FIG. 1 is a side view of high precision slugs manufactured in accordance with the present invention method.
Figure 2:
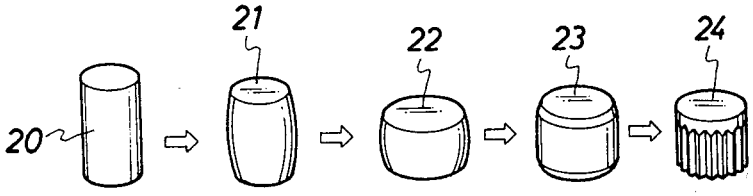
FIG. 2 is a diagram to explain changes of materials in respective steps of slug manufacture in accordance with the present invention.

The method of slug manufacture in accordance with the present invention can be explained by reference to FIG. 2 wherein the starting column material 20 is preformed by cold forming into the primary product 21, the said product 21 is subjected to the upsetting step to convert it into the secondary product 22, and finally the sperical high precision slugs 23 are obtained by the ironing step which is the final process step of the present method. The said high precision slugs 23 are subsequently formed into the final products such as gears 24 by methods known per se in the art.

Figure 3:
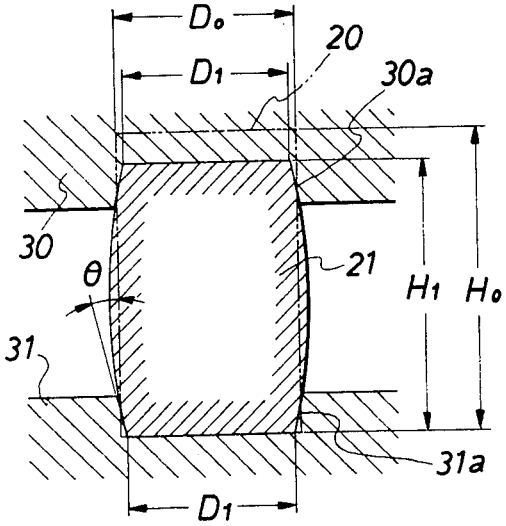
FIG. 3 is an explanatory drawing to explain the preforming step of the instant method to manufacture the primary product.
Figure 4:
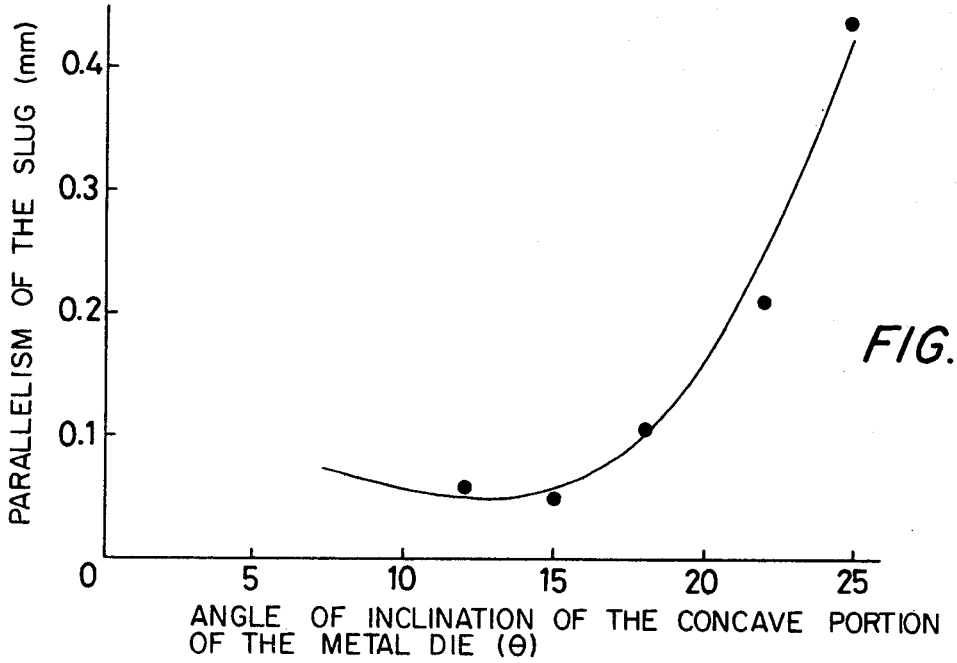
FIG. 4 is a graph to explain the relation of the angle of inclination of the concave portion of the metal die used in the preforming step and the parallelism at both ends of the preformed slug (referred to herein as the primary product).

The preforming process is now explained reference being made to FIGS. 3 and 4. The said starting column material 20 is brought to desired length by press forming, cutting with a saw or lathing, the angle of inclination of the cut section being preferably less than 3°. When the high precision slugs are to be manufactured into final products such as gears, the said starting material should preferably be of less than $H_{RB}$ 90 hardness.

The starting material 20 is preformed by dies 30, 31 into the primary product having sides shaped like a barrel. That is, the diameter Do and length Ho of the said starting material 20 become respectively $D_1$ and $H_1$. The said dies 30, 31 have concave recesses 30*a*, 31*a* on the inner surfaces facing each other.

Figure 10:
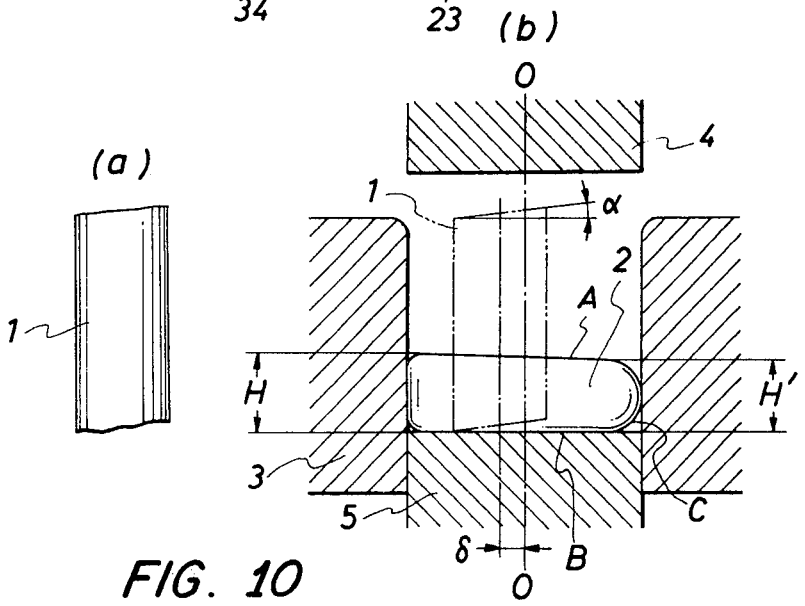
FIG. 10 is an explanatory drawing for the method of manufacturing slugs by the conventional technology.

According to the experiments conducted by the inventor, the said concave recesses were found to be more effective if the concave recess was tapered to have an enlarged cross section at the upper periphery of the die rather than being vertical so as to achieve the barrel shape for the material. Selection of an angle $\theta$ between the outside of the concave recess and the bottom of the concave recess varies the parallelism at the two ends of the preformed slugs as shown in FIG. 4. (Parallelism meaning H–H' (mm) as explained in FIG. 10).

In the concave recess, where the value of the said angle $\theta$ becomes 0°, the edges of the dies cut into the periphery of the preformed slug and leave flaws, whereas an increased angle $\theta$ impairs parallelism of the slug ends. From this result it was confirmed that the inclined angle $\theta$ of the periphery at the concave recess of the dies should preferably be in the range of 8°–18°.

Figure 5:
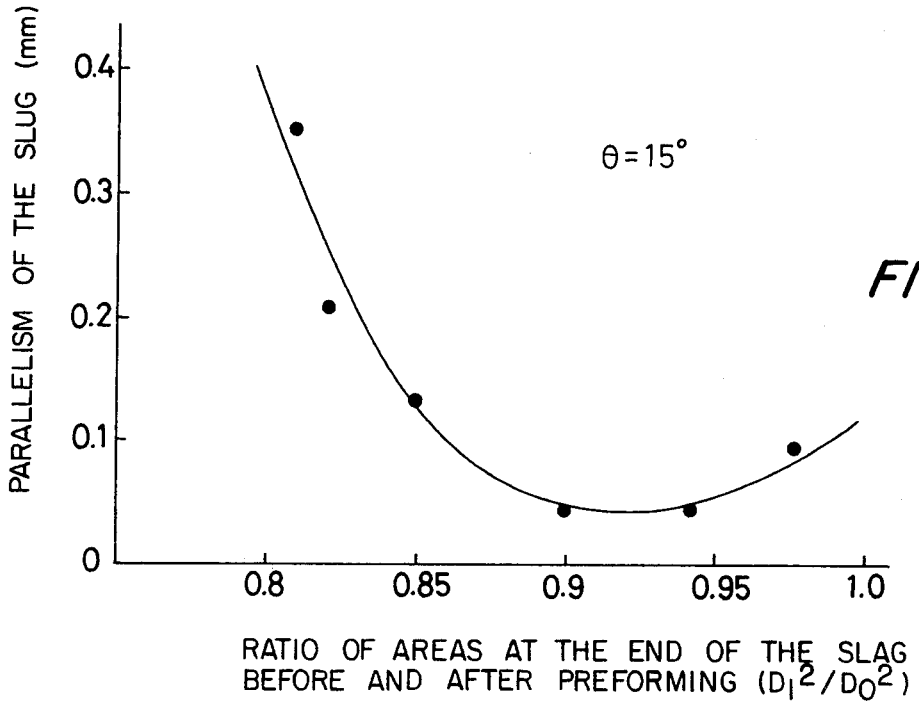
FIG. 5 is a graph to explain the relation between the areas at the end of the slug before and after the preforming step, and the parallelism at two ends of the preformed slugs (primary product).

The said experiments revealed that the relation between the ratio of areas $D_1^2/D_0^2$ at slug ends before and after production of the primary products using dies having an angle $\theta$ of 15° and the parallelism of the slug ends changes as shown in FIG. 5. Seeking these figures is a factor to achieve sphericalness and optimal parallelism in the slug ends which are deformed by the cutting operation of the starting materials. It also becomes another important factor to decrease differences in the maximum outer diameter of the preformed slugs. The optimum value for the ratio of area at the slug ends before and after preforming ($D_1^2/D_0^2$) is shown from the above experiments to be 0.85, and more particularly between 0.90 and 0.95.

Figure 6:
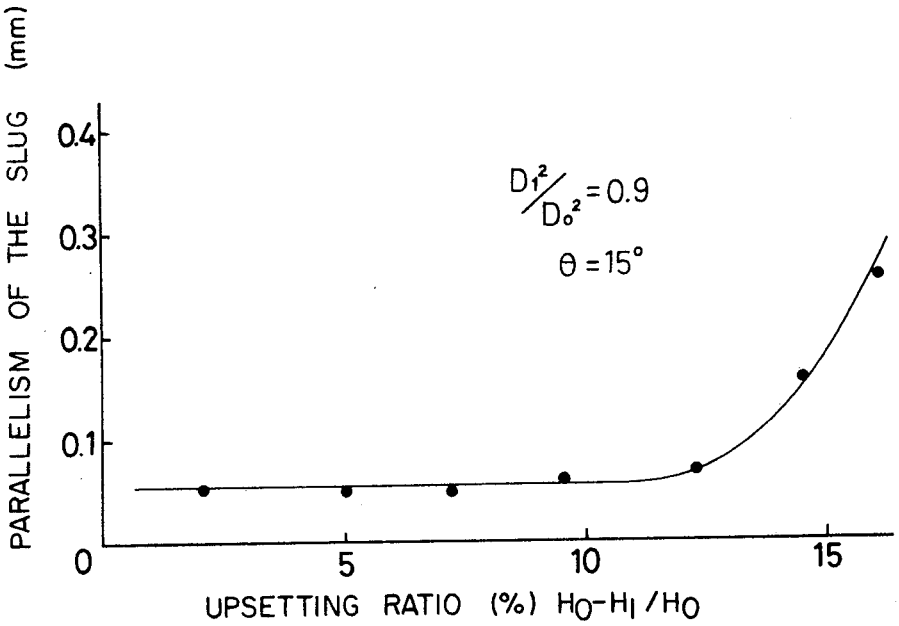
FIG. 6 is a graph to explain the relation between the upsetting ratio of preforming and parallelism at both ends of preformed slug.

FIG. 6 shows the relationship between the slug upsetting ratio $(H_o-H_1)/H_0$ and the parallelism of the slug ends when $\theta$ is 15° and $D_1^1/D_0^2$ is 0.90. According to experiments conducted, parallelism in the slug ends becomes stable when the angle $\theta$ is 15°, $D_1^2/D_0^2$ is 0.9 and the upsetting ratio is less than 15%. An upsetting ratio of over 15% increases restrictions at the slug ends and generates deformations.

Figure 7:
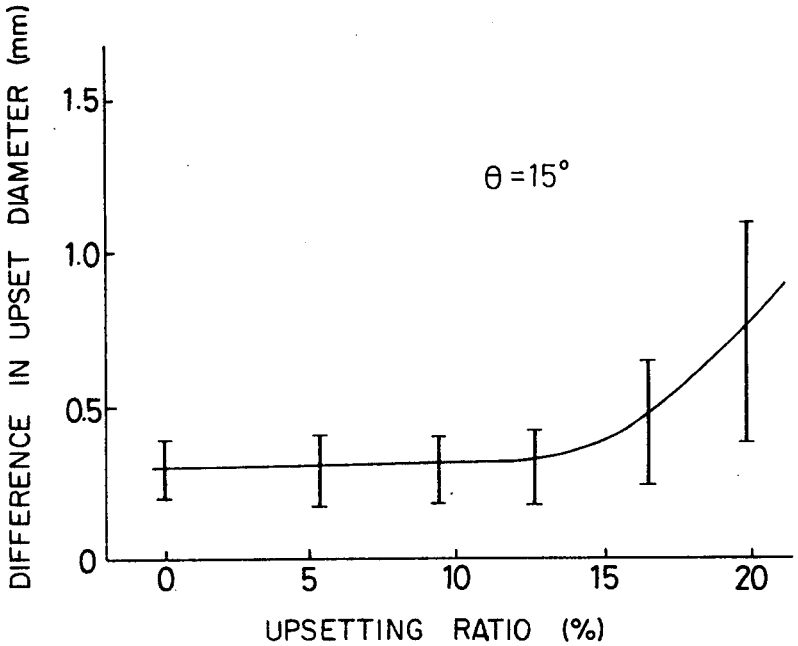
FIG. 7 is a graph to explain the relation between the upsetting ratio of preforming and the difference in the outer diameter of preformed slugs.

The inventor measured the differences in the outer diameter of slugs after preforming and the upsetting ratio when $\theta$ was fixed at 15°. That is, the graph of FIG. 7 shows the result of calculation seeking the diameter difference at the maximum outer diameter and the ends of the preformed slugs caused by the differences in the upsetting ratio. This shows that stable results are obtained when the upsetting ratio is 0–15%. In other words, it will be understood that the inclined angle $\theta$ at the ends of the preforming dies, the ratio of the area at the ends of slug before and after preforming ($D_1^2/D_0^2$), and the upsetting ratio are the decisive factors to maintain the difference in the maximum outer diameter of the preformed slugs at an optimum value.

Figure 8:
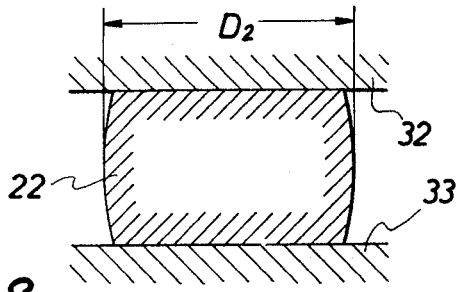
FIG. 8 is an explanatory drawing for the upsetting step of the instant process.

FIG. 8 shows the upsetting step of the process which pressurizes the barrel shaped primary product slugs 21 to obtain the secondary product slugs 22 shaped like a crushed barrel. The primary product is pressed by the metal dies 32, 33 having flat upper and lower surfaces. In the upsetting step, the products are processed to achieve the necessary outer diameter of the high precision slugs while maintaining the highly precise parallelism at both ends of the slugs to thus prepare a product for use in the subsequent process step of ironing. Accordingly, the outer diameter $D_2$ achieved in the upsetting step is somewhat larger than the ironed diameter $D_3$ (see FIG. 9).

Since this is a free upsetting step where no restrictions on the outer diameter are applied, any misalignment between the dies and the primary product may be corrected after processing and optimal parallism obtained. In other words, the precise parallelism at the slug ends is achieved in the aforementioned preforming step. This upsetting step is required to secure the outer diameter to be smoothed out in the following ironing step.

Figure 9:
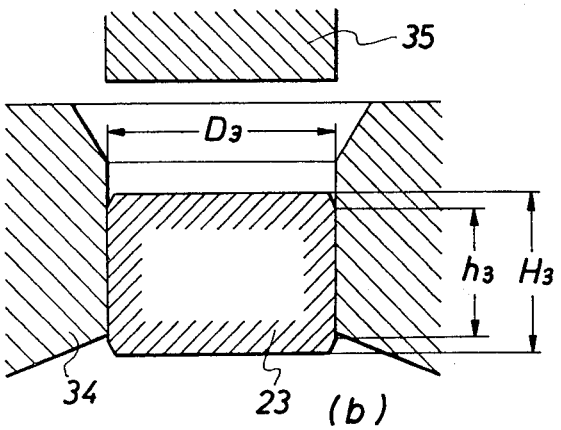
FIG. 9 is an explanatory drawing for the ironing process.

The ironing step shown in FIG. 9 processes the barrel shaped secondary product 22 to spherical high precision slugs 23. Using hollow metal die 34 and punch 35, the secondary product is smoothed into high precision slug 23.

$H_3$ is the total height for the high precision slugs, whereas $h_3$ shows the smoothed face. The optimal ironing value for the ratio $H_3/D_2$ of the diameter $D_2$ at the slug ends before ironing is preferred to be $h_3/H_3 \geqq 0.3$.

Outer diameter $D_3$ achieved in the ironing step is preferred to be substantially the same as the outer diameter of the final desired product 24. This will prevent misalignment in the final desired product, and remarkably improve the precision of the product and the durability of metal dies used to obtain it. Slugs thus manufactured by the steps of preforming, upsetting and ironing are of a high precision and enables the manufacture of high precision products.

We claim

1. A method for manufacturing high precision metal slugs by the cold forming of metals which comprises subjecting a column starting material to a preforming step wherein a primary product is obtained by cold forging with a pair of upper and lower metal dies provided with concave recesses having an inner diameter substantially the same as the outer diameter of the column starting material; subjecting the resultant primary product to an upsetting step wherein the said primary product is pressed again on both ends thereof to obtain a secondary product; subjecting said secondary product to an ironing step wherein the said secondary product is smoothed by hollow dies having an inner diameter which is smaller than the outer diameter of said secondary product and substantially the same as the outer diameter of the final desired product to be produced from the resultant high precision slug.

2. A method according to claim 1 wherein the concave recess of the metal dies used in the said preforming step has an angle $\theta$ which is inclined toward an enlarged section at the periphery of the concave recess.

3. A method according to claim 1 or claim 2 wherein the angle of inclination $\theta$ is set at 8°–18°.

4. A method according to claim 1 wherein the ratio of the area of the slug ends after the said preforming step to the area of the slug ends before the preforming steps is above 0.85 and the upsetting ratio is below 15%.

5. In the method of obtaining high precision slugs by the cold forming of metals, the improvement wherein the process comprises a preforming step wherein primary products are obtained from column starting materials by cold forging with a pair of upper and lower metal dies provided with concave parts having an inner diameter substantially the same to the outer diameter of the column starting materials, an upsetting step wherein the said primary product is pressed again on both ends thereof to obtain a secondary product, an ironing step wherein the said secondary product is smoothed by hollow dies having an inner diameter substantially the same as the outer diameter of the product.

* * * * *